US011772287B1

(12) United States Patent
Crawford et al.

(10) Patent No.: US 11,772,287 B1
(45) **Date of Patent: *Oct. 3, 2023**

(54) FOLDING KNIFE

(71) Applicant: Microtech Knives, Inc., Mills River, NC (US)

(72) Inventors: John Crawford, Canton, NC (US); Kyle Chumchal, Fletcher, NC (US)

(73) Assignee: Microtech Knives, Inc., Mills River, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/183,624

(22) Filed: Mar. 14, 2023

Related U.S. Application Data

(63) Continuation of application No. 17/824,207, filed on May 25, 2022, now Pat. No. 11,633,867.

(51) Int. Cl.
*B26B 1/04* (2006.01)
*B26B 1/10* (2006.01)

(52) U.S. Cl.
CPC ..... *B26B 1/048* (2013.01); *B26B 1/042* (2013.01); *B26B 1/10* (2013.01)

(58) Field of Classification Search
CPC .... B26B 1/00; B26B 1/02; B26B 1/04; B26B 1/048; B26B 1/10
USPC ..... 30/153, 155–161
See application file for complete search history.

(56) References Cited

U.S. PATENT DOCUMENTS 1,056,404 A 3/1913 De Lorenzo
1,231,058 A 6/1917 Pansa
1,614,949 A * 1/1927 Finley ..... B26B 23/00 30/161
2,461,941 A * 2/1949 Sutton ..... A01K 97/14 30/161
2,854,745 A 10/1958 Braverman
3,783,509 A 1/1974 Lake
4,089,112 A 5/1978 Richards
4,451,982 A * 6/1984 Collins ..... B26B 1/048 30/161
4,523,379 A 6/1985 Osterhout
4,573,268 A * 3/1986 Call ..... B26B 1/048 30/161
4,744,146 A 5/1988 Schmidt
4,947,552 A 8/1990 Barnes
5,029,354 A * 7/1991 Boyd, Jr. ..... B26B 1/048 30/161
5,060,379 A 10/1991 Neely
(Continued)

FOREIGN PATENT DOCUMENTS

DE 10 2006 054 422 B3 4/2008
FR 2 732 637 10/1996

*Primary Examiner* — Jason Daniel Prone
(74) *Attorney, Agent, or Firm* — Steve LeBlanc, LLC

(57) ABSTRACT

A folding knife includes a handle, a first liner inside the handle, and a second liner inside the handle and opposed to the first liner. A blade has a tang and a cutting edge, and the tang of the blade pivotally connects the blade between the first and second liners. The blade has a retracted position in which the cutting edge is inside the handle and a deployed position in which the cutting edge is outside the handle. An actuator is at least partially between the first and second liners, and a spring is between the first and second liners and in compression against the actuator so that the spring biases the actuator toward the tang of the blade.

17 Claims, 7 Drawing Sheets

(56) References Cited

U.S. PATENT DOCUMENTS 5,095,624 A * 3/1992 Ennis ..... B26B 1/04 30/161
5,111,581 A * 5/1992 Collins ..... B26B 1/048 30/161
5,502,895 A 4/1996 Lemaire
5,511,311 A 4/1996 Collins
5,617,635 A 4/1997 Berns
5,722,168 A 3/1998 Huang
5,737,841 A * 4/1998 McHenry ..... B26B 1/048 30/161
5,815,927 A * 10/1998 Collins ..... B26B 1/048 30/161
5,819,414 A 10/1998 Marifone
5,839,194 A * 11/1998 Bezold ..... B26B 1/048 30/161
6,079,106 A * 6/2000 Vallotton ..... B26B 1/048 30/161
6,085,423 A 7/2000 Marifone
6,101,724 A 8/2000 Halligan
6,145,202 A * 11/2000 Onion ..... B26B 1/048 30/161
6,148,522 A 11/2000 Dobandi
6,154,965 A 12/2000 Sakai
6,378,214 B1 * 4/2002 Onion ..... B26B 1/048 30/161
6,668,460 B2 12/2003 Feng
6,675,484 B2 1/2004 McHenry
6,684,510 B1 * 2/2004 Collins ..... B26B 1/048 30/161
6,751,868 B2 * 6/2004 Glesser ..... B26B 1/048 30/161
7,032,315 B1 * 4/2006 Busse ..... B26B 1/048 30/153
7,080,457 B2 * 7/2006 Sullivan ..... B26B 1/046 30/161
7,086,158 B1 8/2006 Halpern
7,246,441 B1 * 7/2007 Collins ..... B26B 1/048 30/160
7,305,729 B2 12/2007 Dehner
7,305,769 B2 12/2007 McHenry
7,340,837 B1 * 3/2008 Busse ..... B26B 1/048 30/160
7,395,599 B2 * 7/2008 Onion ..... B26B 1/02 30/159
7,506,446 B2 * 3/2009 Onion ..... B26B 1/048 30/161
RE41,259 E 4/2010 McHenry et al.
7,694,421 B2 * 4/2010 Lin ..... B26B 1/046 30/160
7,797,838 B2 9/2010 Chu
7,941,927 B1 * 5/2011 Demko ..... B26B 1/048 30/161
7,979,990 B2 * 7/2011 Hawk ..... B26B 1/048 30/161
8,028,419 B2 10/2011 VanHoy
8,375,590 B2 * 2/2013 Duey ..... B26B 1/048 30/160
8,413,338 B2 * 4/2013 Freeman ..... B26B 1/048 30/161
8,671,578 B1 3/2014 Frazer
8,935,855 B2 1/2015 Qui
9,346,176 B2 * 5/2016 Collins ..... B26B 1/048
9,573,262 B2 2/2017 Sheahan
9,815,213 B2 * 11/2017 Duey ..... B26B 1/048
10,071,489 B2 9/2018 MacNair
10,160,122 B2 * 12/2018 Busse ..... B26B 1/048
10,189,170 B2 1/2019 Marfione et al.
10,632,632 B1 * 4/2020 Demko ..... B26B 1/048
10,661,457 B2 * 5/2020 France ..... B26B 1/048
10,737,401 B1 8/2020 Coves et al.
10,751,890 B1 8/2020 Marione
11,220,013 B1 * 1/2022 Valerio, II ..... B26B 1/048
11,633,867 B1 * 4/2023 Crawford ..... B26B 1/048 30/151
2003/0070299 A1 4/2003 Frazer
2004/0045170 A1 3/2004 Glesser
2004/0154169 A1 * 8/2004 McCann ..... B26B 1/048 30/161
2005/0044717 A1 3/2005 Nishihara
2005/0252010 A1 11/2005 Freeman
2006/0143929 A1 7/2006 Lake
2006/0272157 A1 * 12/2006 Zeng ..... B26B 1/048 30/161
2007/0204468 A1 9/2007 Cheng
2008/0222896 A1 * 9/2008 Marfione ..... B26B 1/048 30/160
2009/0056146 A1 * 3/2009 Duey ..... B26B 1/048 30/159
2010/0192381 A1 * 8/2010 Sakai ..... B26B 1/048 30/160
2012/0180320 A1 7/2012 Lo
2012/0304470 A1 12/2012 Freeman
2013/0133205 A1 * 5/2013 Lo ..... B26B 1/048 30/160
2015/0343650 A1 * 12/2015 Valdez ..... B26B 1/02 30/159
2015/0367520 A1 12/2015 MacNair
2016/0207207 A1 * 7/2016 Tom ..... B26B 1/048
2017/0120461 A1 * 5/2017 Tom ..... B26B 1/048
2018/0021963 A1 * 1/2018 Liao ..... B26B 1/048 30/161
2018/0169875 A1 6/2018 Valdez
2019/0061181 A1 2/2019 France
2020/0001476 A1 * 1/2020 Allen ..... B26B 1/048
2020/0101631 A1 * 4/2020 Moon ..... B26B 1/04

* cited by examiner

FOLDING KNIFE

RELATED APPLICATIONS

The present application is a Continuation of U.S. Patent Application entitled "A Folding Knife," Ser. No. 17/824,207 filed on May 25, 2022, now U.S. Pat. No. 11,633,867, all of which is hereby incorporated herein by reference in its entirety for all purposes. Any disclaimer that may have occurred during prosecution of the above-referenced application is hereby expressly rescinded.

FIELD OF THE INVENTION

The present invention generally involves a folding knife. In particular embodiments, the folding knife may be manually operated, single action, or double action.

BACKGROUND OF THE INVENTION

Pocket knives provide a convenient tool for cutting that may be easily carried by a user. A folding knife is a particular style of pocket knife that has a blade pivotally connected to a handle. The handle generally includes a pair of scales that sandwich the blade between them, and the blade pivots with respect to the scales to transition between retracted and deployed positions. When retracted, a cutting edge of the blade resides between the scales, and the scales protect the cutting edge from inadvertent contact that might damage the cutting edge or cause personal injury. When deployed, the blade extends from the scales to expose the cutting edge for use.

A manually operated folding knife requires a user to physically rotate the blade with respect to the handle to reposition the blade between the retracted and deployed positions. A single action folding knife includes a spring that engages with the blade to automatically deploy the blade, and the user must apply force to the blade to overcome the spring force to manually pivot the blade with respect to the handle to return the blade to the retracted position. A double action folding knife includes a spring that engages with the blade to automatically deploy and retract the blade.

Folding knife designs often balance competing goals of aesthetics, safety, and ease of operation, maintenance, and repair. The appearance of the blade and handle generally provide the aesthetic characteristics of a folding knife. An actuator and/or lock incorporated into the handle enhances safety by preventing inadvertent movement of the blade between the deployed and retracted positions. However, the additional components associated with the actuator and/or lock often complicate the assembly, maintenance, and repair of the folding knife and the ability to readily substitute blades or scales to change the aesthetics of the pocket knife. Therefore, the need exists for an improved folding knife design that can securely hold the blade in the retracted and deployed positions without complicating the assembly, maintenance, and repair of the folding knife or the ability to change the blade and/or handle to alter the aesthetic characteristics of the folding knife.

BRIEF DESCRIPTION OF THE INVENTION

Aspects and advantages of the invention are set forth below in the following description, or may be obvious from the description, or may be learned through practice of the invention.

One embodiment of the present invention is a folding knife that includes a first scale and a second scale opposed the first scale. A first liner is between the first and second scales, and a second liner is between the first and second scales and opposed to the first liner. A blade has a tang and a cutting edge, and the tang of the blade pivotally connects the blade between the first and second liners. The blade has a retracted position in which the cutting edge is between the first and second scales and a deployed position in which the cutting edge is outside the first and second scales. An actuator is at least partially between the first and second liners, and a spring is between the first and second liners. A dowel at least partially between the first and second liners holds the spring in compression against the actuator so that the spring biases the actuator toward the tang of the blade.

An alternate embodiment of the present invention is a folding knife that includes a handle, a first liner inside the handle, and a second liner inside the handle and opposed to the first liner. A blade has a tang and a cutting edge, and the tang of the blade pivotally connects the blade between the first and second liners. The blade has a retracted position in which the cutting edge is inside the handle and a deployed position in which the cutting edge is outside the handle. An actuator is at least partially between the first and second liners, and a spring is between the first and second liners and in compression against the actuator so that the spring biases the actuator toward the tang of the blade.

In yet another embodiment of the present invention, a folding knife includes a handle, a first liner inside the handle, and a second liner inside the handle and opposed to the first liner. A blade has a tang and a cutting edge, and the tang of the blade pivotally connects the blade between the first and second liners. The blade has a retracted position in which the cutting edge is inside the handle and a deployed position in which the cutting edge is outside the handle. An actuator is at least partially between the first and second liners, and the actuator has a first position engaged with the tang of the blade and a second position that allows movement of the blade between the retracted position and the deployed position. A spring is between the first and second liners, and a dowel at least partially between the first and second liners holds the spring in compression against the actuator so that the spring biases the actuator toward the tang of the blade.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
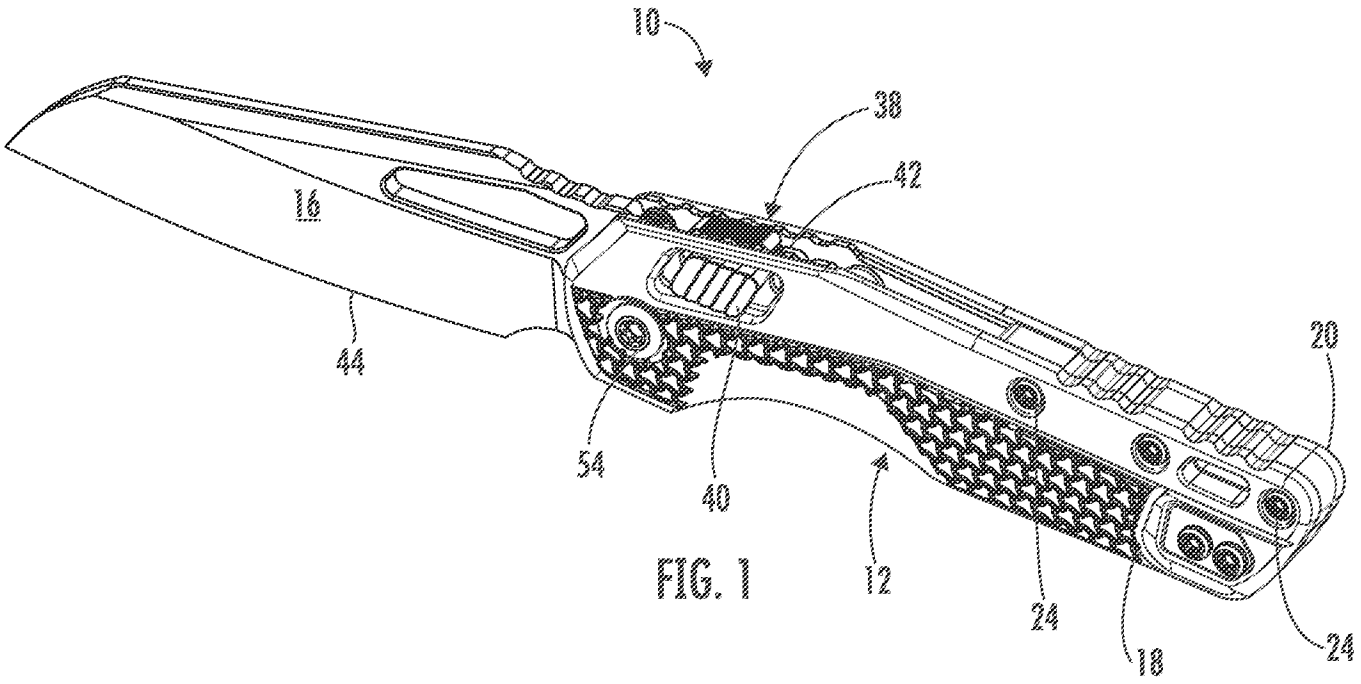
FIG. 1 is a perspective view of a folding knife according to one embodiment of the present invention in a deployed position.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

The present invention is a folding knife with a blade that folds into a handle of the folding knife. Embodiments of the present invention include a modular actuator/lock that allows the blade to be retracted and deployed while also locking the blade in one or both of the positions, thereby enhancing the safety and ease of operation of the folding knife. In addition, the modular design of the actuator/lock enables a user to change the blade and/or handle without disassembling the actuator/lock, thereby enhancing to ability to assemble, maintain, and repair the folding knife and/or alter the aesthetic characteristics of the folding knife. Although various embodiments are illustrated as a manual folding knife, one of ordinary skill in the art will readily appreciate that embodiments of the present invention may include a single or double action folding knife, and the present invention is not limited to a particular configuration or action unless specifically recited in the claims.

Figure 2:
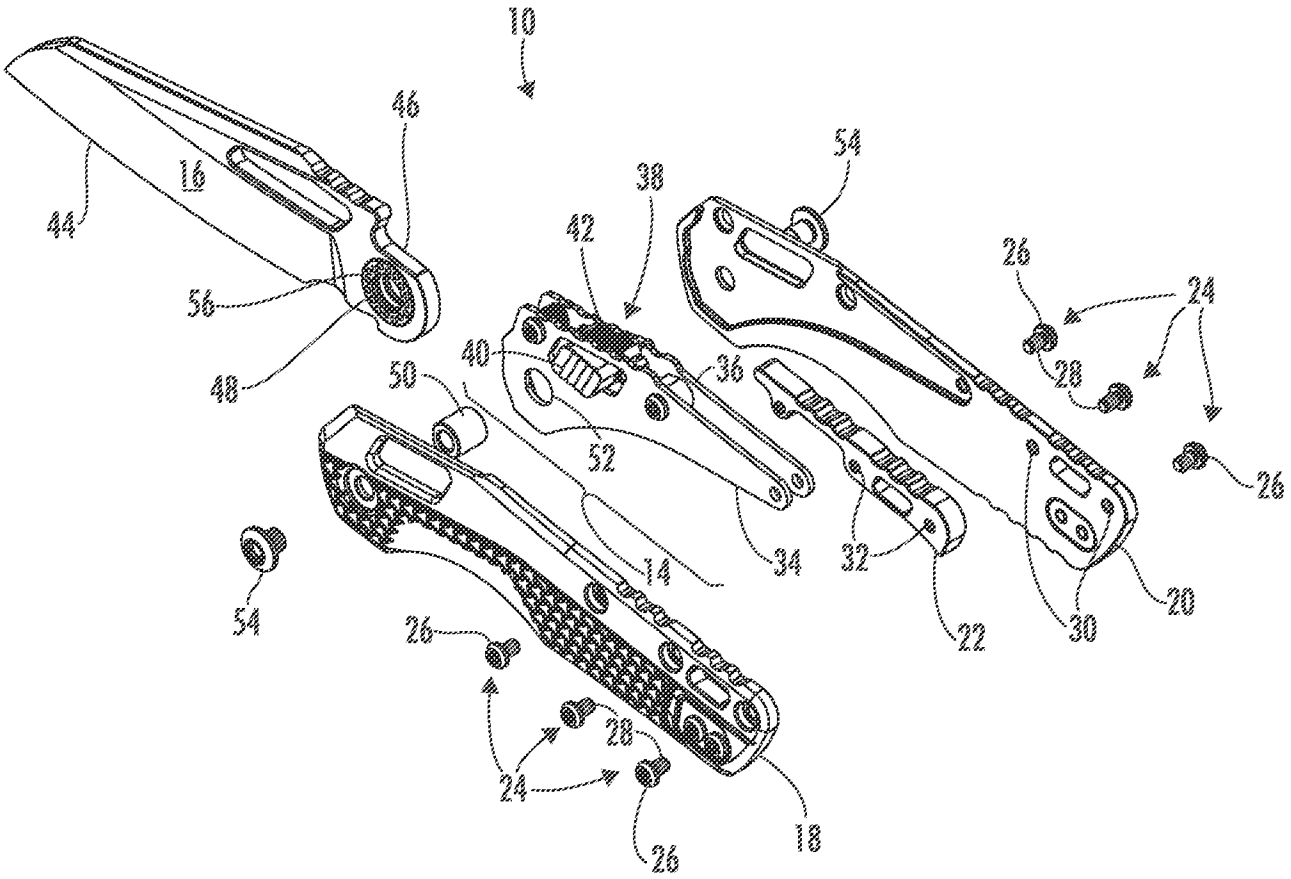
FIG. 2 is an exploded perspective view of the folding knife shown in FIG. 1.

FIG. 1 provides a perspective view of a folding knife 10 according to one embodiment of the present invention in a deployed position, and FIG. 2 provides an exploded perspective view of the folding knife 10 shown in FIG. 1. As shown in FIGS. 1 and 2, the folding knife 10 generally includes a handle 12, a modular actuator/lock 14 (shown more clearly in FIG. 2), and a blade 16.

The handle 12 houses and supports the modular actuator/lock 14 and the blade 16 and provides the primary structure for holding the folding knife 10 during use. The handle 12 may be constructed from metal, fiberglass, carbon, polymers, or other composite materials known in the art, and the outside of the handle 12 may include various textured surfaces to facilitate handling and gripping the folding knife 10. The handle 12 may be a single-piece construction, but more commonly includes a first or left scale 18 and a second or right scale 20 opposed to the left scale 18. As shown in FIG. 2, the folding knife 10 may further include a spacer 22 between the first and second scales 18, 20 to provide support and structure for the first and second scales 18, 20. In the particular embodiment shown in FIG. 2, the optional spacer 22 fits into the modular actuator/lock 14; however, the present invention is not limited to any particular location for the optional spacer 22 unless specifically recited in the claims.

The left and right scales 18, 20 connect together on opposing sides of the modular actuator/lock 14 and blade 16 using a means for releasably connecting the left scale 18 to the right scale 20. The function of the means is to releasably connect the left scale 18 to the right scale 20. The structure for performing this function may be one or more screws 24 or equivalent structure for releasably connecting one component to another. Each screw 24 may have a head end 26 and a threaded end 28. The head end 26 of each screw 24 may engage with one of the left or right scales 18, 20, and each screw 24 may extend through the spacer 22 (if present) to the opposite scale 20, 18 so that the threaded end 28 of each screw 24 threadingly engages with holes 30 in the opposite scale 20, 18. Alternately, as shown in FIG. 2, the structure for releasably connecting the left scale 18 to the right scale 20 may further include the spacer 22, and the threaded end 28 of each screw 24 may threadingly engage with holes 32 in the spacer 22. In this manner, the screws 24 releasably connect the left scale 18 to the right scale 20 by releasably connecting each scale 18, 20 to the spacer 22 between the scales 18, 20.

As shown in FIG. 2, the modular actuator/lock 14 includes a first or left liner 34, a second or right liner 36, and an actuator 38. The left and right liners 34, 36 are opposed to one another inside the handle 12 or between the left and right scales 18, 20 to house and support the actuator 38 and other components of the modular actuator/lock 14 as will be described with respect to FIGS. 3 and 4. The actuator 38 is at least partially between the left and right liners 34, 36 with first or vertical surfaces 40 and a second or horizontal surface 42 that is orthogonal to the vertical surfaces 40. One or both of the vertical surfaces 40 extend through the left and/or right liners 34, 36 and the left and/or right scales 18, 20. The horizontal surface 42 extends above the left and right liners 34, 36 and through the handle 12. In this manner, the vertical and horizontal surfaces 40, 42 of the actuator 38 are readily accessible for operation by the user.

Figure 5:
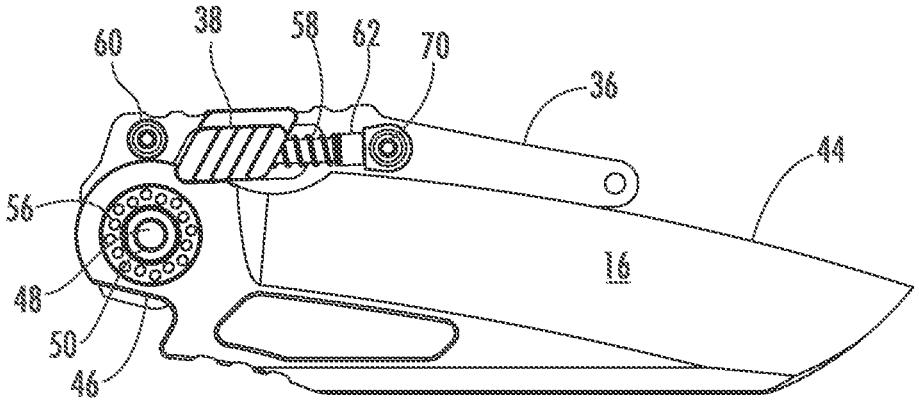
FIG. 5 is a left side plan view of the modular actuator/lock and blade with the left liner removed and the blade locked in a retracted position.

The blade 16 is typically made of hardened or heat-treated steel, titanium, or other suitable material and generally includes a cutting edge 44 along one or both sides and a tang 46 at one end. In particular embodiments, the cutting edge 44 may be curved, straight, and/or serrated. The tang 46 generally refers to the unsharpened, unexposed portion of the blade 16 sandwiched between the left and right scales 18, 20. The tang 46 pivotally connects the blade 16 between the left and right liners 34, 36. As shown in FIG. 2, for example, the tang 46 may include a through bore 48, and a cylindrical retainer 50 may slide through holes 52 in the left and right liners 34, 36 and the through bore 48 to pivotally connect the blade 16 between the left and right liners 34, 36. The inner surface of the left and right scales 18, 20 may hold the retainer 50 in place. Alternately, a pair of screws 54 engaged with the outer surfaces of the left and right scales 18, 20 may be threaded into opposite sides of the retainer 50 to more securely hold the retainer 50 in place. A bearing 56 may be included in the through bore 48 of the tang 44 to reduce the friction between the tang 44 and the retainer 50 as the blade 16 pivots between the left and right liners 34, 36. In this manner, the blade 16 has a deployed position (shown in FIGS. 1, 2, 8 and 9) in which the cutting edge 44 is outside the handle 12 or left and right scales 18, 20 and a retracted position (shown in FIGS. 5 and 6) in which the cutting edge 44 is inside the handle 12 or between the left and right scales 18, 20.

Figure 3:
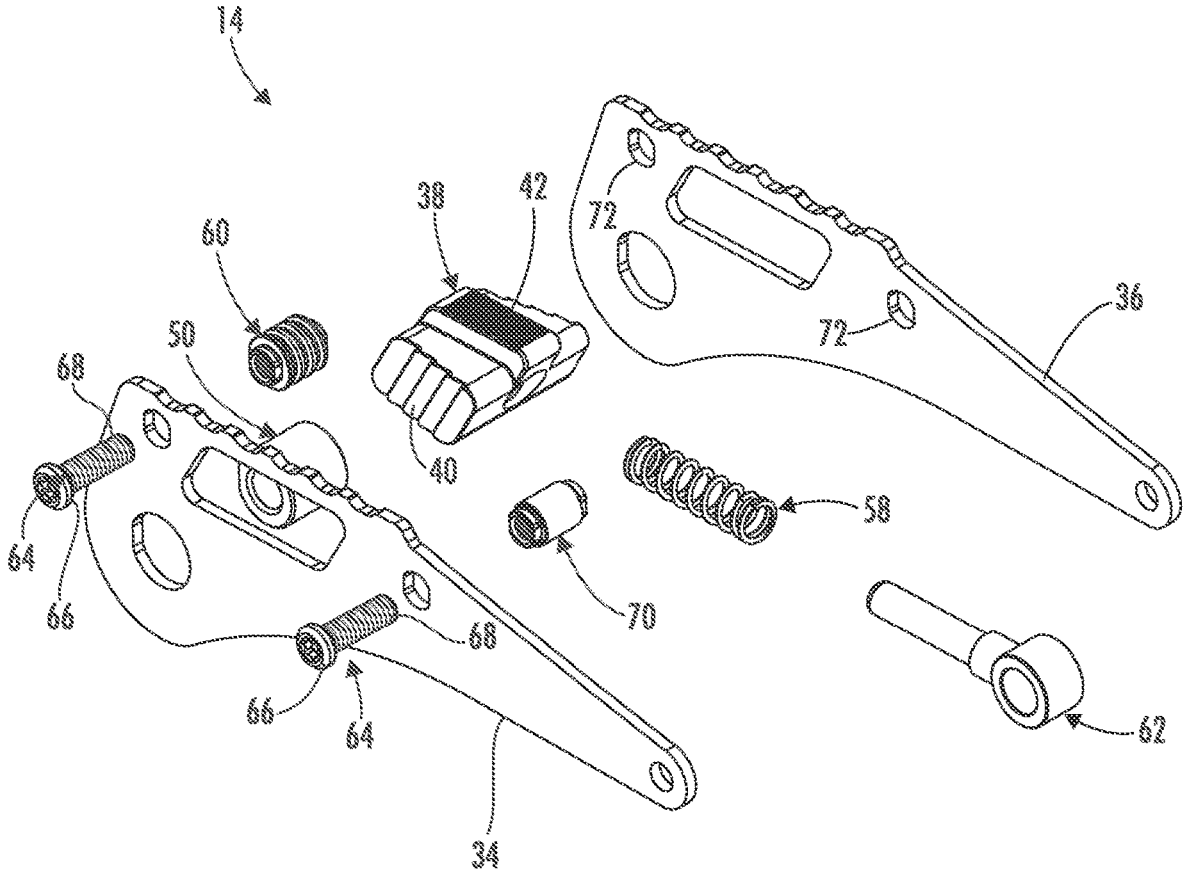
FIG. 3 is an exploded perspective view of a modular actuator/lock according to an embodiment of the present invention.

FIG. 3 provides an exploded perspective view of the modular actuator/lock 14 according to an embodiment of the present invention. As previously described with respect to FIG. 2, the left and right liners 34, 36 are opposed to one another inside the handle 12 or between the left and right scales 18, 20 to house and support the actuator 38 and other components of the modular actuator/lock 14. The actuator 38 is at least partially between the left and right liners 34, 36 with first or vertical surfaces 40 that extend through the left and/or right liners 34, 36 and the left and/or right scales 18, 20. The second or horizontal surface 42 is orthogonal to the vertical surfaces 40 and extends above the left and right liners 34, 36 and through the handle 12.

As shown in FIG. 3, the modular actuator/lock 14 may further include a spring 58 and a stop pin 60 between the left and right liners 34, 36. A dowel 62 may hold the spring 58 in compression against the actuator 38 so that the spring 58 biases the actuator 38 toward the tang 46 of the blade 16. As will be described with respect to FIGS. 5-9, the actuator 38 has a first position engaged with the tang 46 of the blade 16 to lock the blade 16 in position and a second position that allows movement of the blade 16 between the retracted and deployed positions. As will also be described with respect to FIGS. 5-9, the stop pin 60 may be engaged with the blade 16 when the blade 16 is in the deployed position.

The modular actuator/lock 14 further includes a means for releasably connecting the left liner 34 to the right liner 36 independently from the left and right scales 18, 20. The function of the means is to releasably connect the left liner 34 to the right scale 36 independently from the left and right scales 18, 20. As used herein, the phrase "independently from the left and right scales 18, 20" requires that the means releasably connects the left liner 34 to the right liner 36 regardless of the presence or absence of the left and right scales 18, 20, and the removal or disassembly of the left and right scales 18, 20, without any further action, does not release the connection between the left and right liners 34, 36. The structure for performing this function may be one or more screws 64 or equivalent structure for releasably connecting one component to another. In the embodiment shown in FIG. 3, for example, the structure for performing this function includes two screws 64, and each screw may have a head end 66 and a threaded end 68. The head end 66 of each screw 64 may engage with one liner 34. One screw 64 may extend through the stop pin 60 to the opposite liner 36, while the other screw 64 may extend through a spacer 70 in the dowel 62 to the opposite liner 36. The threaded end 68 of each screw 64 may then threadingly engage with holes 72 in the opposite liner 36 to releasably connect the left liner 34 to the right liner 36 independently from the left and right scales 18, 20.

Figure 4:
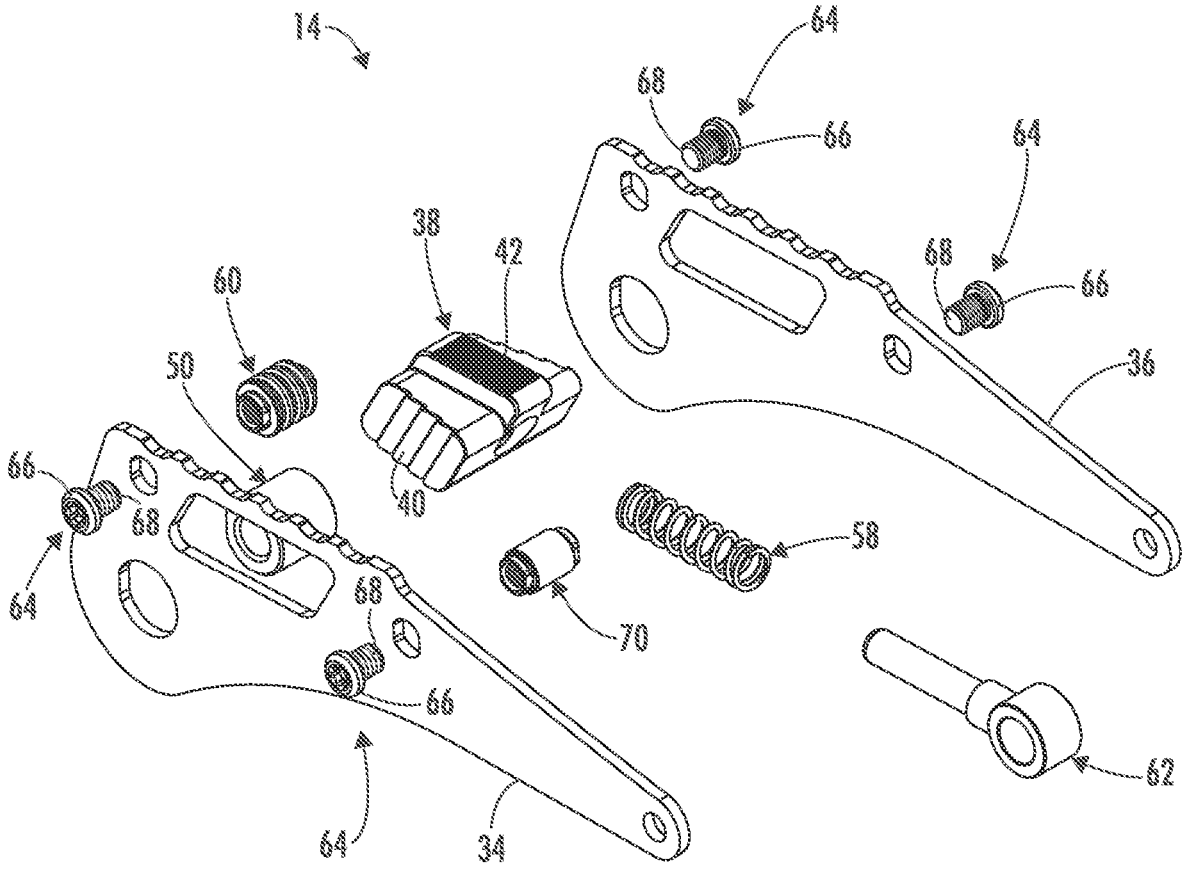
FIG. 4 is an exploded perspective view of the modular actuator/lock according to an alternate embodiment of the present invention.

FIG. 4 provides an exploded perspective view of the modular actuator/lock 14 according to an alternate embodiment of the present invention. As shown in FIG. 4, the structure for releasably connecting the left liner 34 to the right liner 36 independently from the left and right scales 18, 20 may include four screws 64, the stop pin 60, and the spacer 70. In this embodiment of the modular actuator/lock 14, two screws 64 are on each side of the modular actuator/lock 14 so that the head end 66 of each screw 64 may again engage with one liner 34, 36. The threaded ends 68 of two screws 64 may threadingly engage with opposite sides of the stop pin 60, while the threaded ends 68 of the other two screws 64 may threadingly engage with opposite sides of the spacer 70. In this manner, the four screws 64, stop pin 60, and spacer 70 releasably connect the left liner 34 to the right liner independently from the left and right scales 18, 20 by releasably connecting each liner 34, 36 to the stop pin 60 and spacer 70 between the liners 34, 36.

Operation of the folding knife 10 will now be described with respect to FIGS. 5-9. Each figure provides a side plan view of the modular actuator/lock 14 and blade 16 with the left liner 34 removed and the blade 16 and actuator 38 in various positions. Starting with FIG. 5, the blade 16 is in the retracted position with the cutting edge 44 inside the handle 12 or between the left and right scales 18, 20. The dowel 62 holds the spring 58 in compression against the actuator 38 so that the spring 58 biases the actuator 38 to the first position with the actuator 38 engaged with the tang 46 of the blade 16. As a result, the actuator 38 prevents the blade 16 from rotating clockwise, thereby locking the blade 16 in the retracted position.

Figure 6:
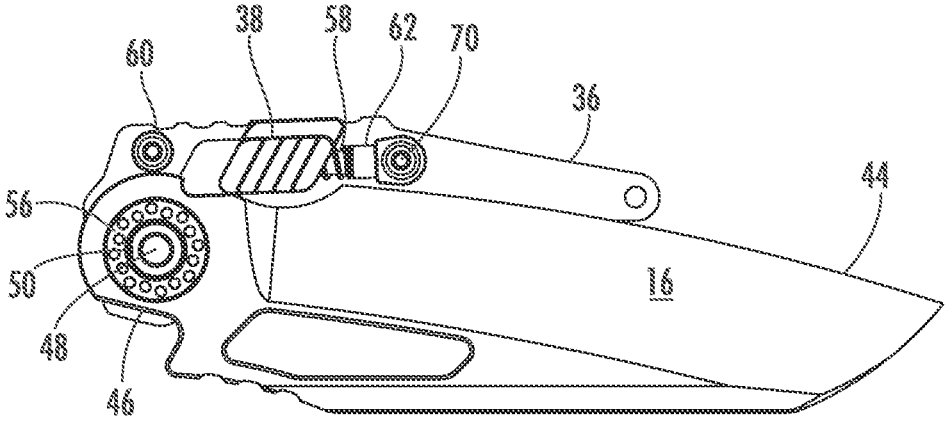
FIG. 6 is a left side plan view of the modular actuator/lock and blade with the left liner removed and the blade unlocked in the retracted position.
Figure 7:
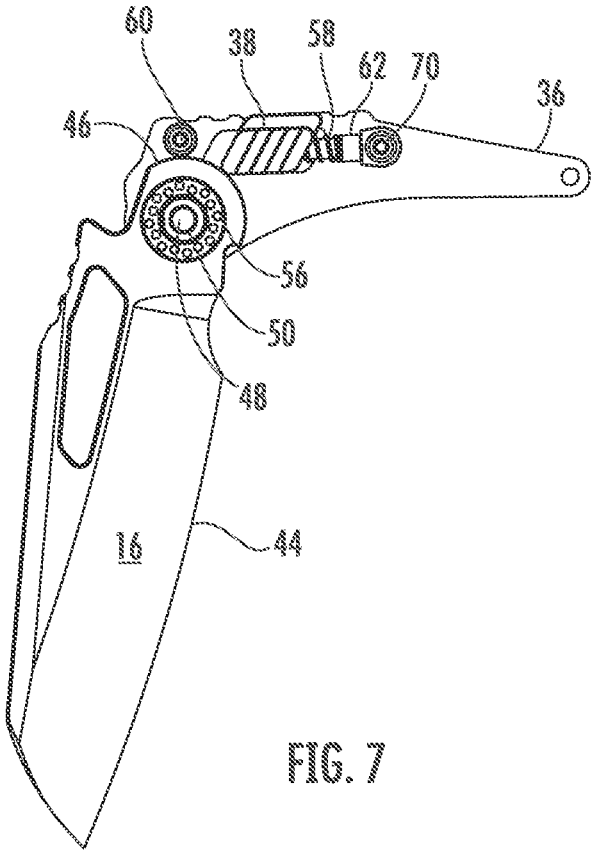
FIG. 7 is a left side plan view of the modular actuator/lock and blade with the left liner removed and the blade unlocked in an intermediate position.

In FIG. 6, the actuator 38 has been manually moved to the right against the compression of the spring 58 and held in the second position. In the second position, the actuator 38 is no longer engaged with the tang 46, and the user may manually rotate the blade 16 clockwise from the retracted position. In FIG. 7, the user has manually rotated the blade 16 clockwise from the retracted position. As shown in FIG. 7, the tang 46 of the blade 16 slides against the actuator 38 to prevent the actuator 38 from moving left and returning to the first position.

Figure 8:
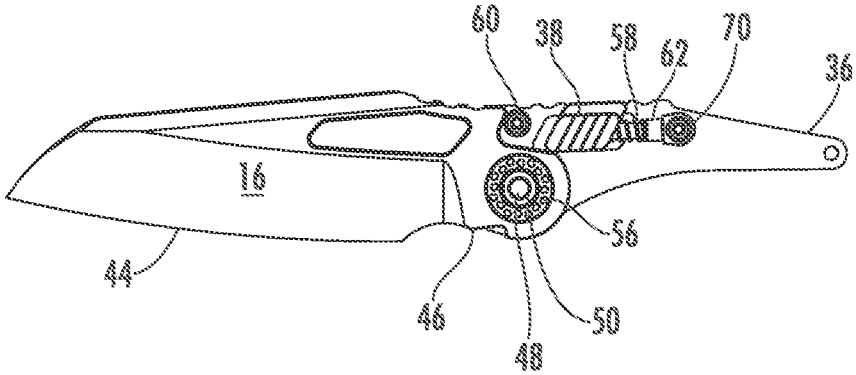
FIG. 8 is a left side plan view of the modular actuator/lock and blade with the left liner removed and the blade locked in the deployed position.

In FIG. 8, the blade 16 has reached the deployed position with the cutting edge 44 outside of the handle 12. The stop pin 60 is engaged with the tang 46 of the blade 16 to prevent the blade 16 from further clockwise rotation. In addition, the spring 58 has returned the actuator 38 to the first position with the actuator 38 again engaged with the tang 46 of the blade 16. As a result, the actuator 38 prevents the blade 16 from rotating counter-clockwise, thereby locking the blade 16 in the deployed position.

Figure 9:
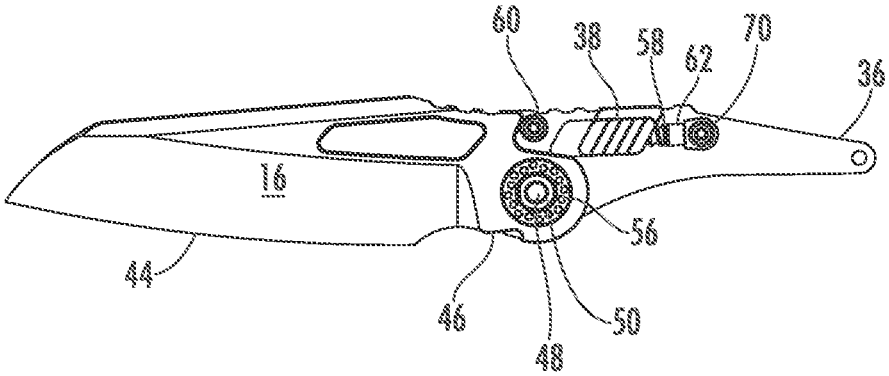
FIG. 9 is a left side plan view of the modular actuator/lock and blade with the left liner removed and the blade unlocked in the deployed position.

In FIG. 9, the actuator 38 has been manually moved to the right against the compression of the spring 58 and held in the second position. In the second position, the actuator 38 is no longer engaged with the tang 46, and the user may manually rotate the blade 16 counter-clockwise from the deployed position.

The modular actuator/lock 14 thus allows the blade 16 to be retracted and deployed while also locking the blade 16 in one or both of the positions, thereby enhancing the safety and ease of operation of the folding knife 10. In addition, the modular design of the actuator/lock 14 enables a user to change the blade 16 and/or handle 12 without disassembling the actuator/lock 14, thereby enhancing to ability to assemble, maintain, and repair the folding knife 10 and/or alter the aesthetic characteristics of the folding knife 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A folding knife, comprising:

a first scale;

a second scale opposed the first scale;

a first liner between the first and second scales;

a second liner between the first and second scales and opposed to the first liner;

a blade having a tang and a cutting edge, wherein the tang of the blade pivotally connects the blade between the first and second liners, the blade has a retracted position in which the cutting edge is between the first and second scales, and the blade has a deployed position in which the cutting edge is outside the first and second scales;

an actuator at least partially between the first and second liners, wherein the actuator has a first surface that extends through the first liner and the first scale and a second surface orthogonal to the first surface that extends above the first and second liners;

a spring between the first and second liners; and a dowel at least partially between the first and second liners that holds the spring in compression against the actuator so that the spring biases the actuator toward the tang of the blade.

2. The folding knife as in claim 1, wherein the actuator has a first position engaged with the tang of the blade and a second position that allows movement of the blade between the retracted position and the deployed position.

3. The folding knife as in claim 1, further comprising a means for releasably connecting the first liner to the second liner independently from the first and second scales.

4. The folding knife as in claim 3, wherein the means for releasably connecting the first liner to the second liner independently from the first and second scales comprises a plurality of screws between the first and second scales that releasably connect the first liner to the second liner.

5. The folding knife as in claim 4, wherein the means for releasably connecting the first liner to the second liner independently from the first and second scales comprises a spacer between the first and second liners, and the plurality of screws between the first and second scales releasably connect to the spacer between the first and second liners.

6. The folding knife as in claim 1, further comprising a stop pin between the first and second liners and engaged with the blade when the blade is in the deployed position.

7. The folding knife as in claim 1, further comprising a means for releasably connecting the first scale to the second scale.

8. A folding knife, comprising:

a handle;

a first liner inside the handle;

a second liner inside the handle and opposed to the first liner;

a blade having a tang and a cutting edge, wherein the tang of the blade pivotally connects the blade between the first and second liners, the blade has a retracted position in which the cutting edge is inside the handle, and the blade has a deployed position in which the cutting edge is outside the handle;

an actuator at least partially between the first and second liners, wherein the actuator has a first surface that extends through the first liner and the handle and a second surface orthogonal to the first surface that extends above the first and second liners; and a spring between the first and second liners and in compression against the actuator so that the spring biases the actuator toward the tang of the blade.

9. The folding knife as in claim 8, wherein the actuator has a first position engaged with the tang of the blade and a second position that allows movement of the blade between the retracted position and the deployed position.

10. The folding knife as in claim 8, further comprising a dowel at least partially between the first and second liners that holds the spring in compression against the actuator so that the spring biases the actuator toward the tang of the blade.

11. The folding knife as in claim 8, further comprising a stop pin between the first and second liners and engaged with the blade when the blade is in the deployed position.

12. The folding knife as in claim 8, further comprising a screw inside the handle having a first end and an opposed second end, wherein the first end of the screw is engaged with the first liner, and the second end of the screw is threadingly engaged with the second liner.

13. A folding knife, comprising:

a handle;

a first liner inside the handle;

a second liner inside the handle and opposed to the first liner;

a blade having a tang and a cutting edge, wherein the tang of the blade pivotally connects the blade between the first and second liners, the blade has a retracted position in which the cutting edge is inside the handle, and the blade has a deployed position in which the cutting edge is outside the handle;

an actuator at least partially between the first and second liners, wherein the actuator has a first position engaged with the tang of the blade, a second position that allows movement of the blade between the retracted position and the deployed position, a first surface that extends through the first liner and the handle, and a second surface orthogonal to the first surface that extends above the first and second liners;

a spring between the first and second liners; and a dowel at least partially between the first and second liners that holds the spring in compression against the actuator so that the spring biases the actuator toward the tang of the blade.

14. The folding knife as in claim 13, further comprising a stop pin between the first and second liners and engaged with the blade when the blade is in the deployed position.

15. The folding knife as in claim 14, further comprising a screw inside the handle that extends through the second liner and threadingly engages with the stop pin.

16. The folding knife as in claim 13, further comprising a screw inside the handle having a first end and an opposed second end, wherein the first end of the screw is engaged with the first liner and the second end of the screw is threadingly engaged with the second liner.

17. The folding knife as in claim 13, further comprising a retainer that extends through the first and second liners and engages with the tang of the blade to define the pivot connection.

* * * * *